US006152621A

United States Patent [19]

Langan

[11] Patent Number: 6,152,621

[45] Date of Patent: Nov. 28, 2000

[54] MULTICOLOR THERMAL TRANSFER IMAGING PROCESS

[75] Inventor: Joseph W. Langan, Cheektowaga, N.Y.

[73] Assignee: Moore U.S.A., Inc., Grand Island, N.Y.

[21] Appl. No.: 09/241,424

[22] Filed: Feb. 2, 1999

[51] Int. Cl.[7] ..... B41J 2/315

[52] U.S. Cl. ..... 400/120.02; 400/120.01; 400/240.3; 347/172

[58] Field of Search ..... 400/120.02, 240, 400/240.3, 240.4, 240.2, 120.01; 347/172

[56] References Cited

U.S. PATENT DOCUMENTS

| | | | |
|---|---|---|---|
| 4,558,329 | 12/1985 | Honda | 400/240.3 X |
| 4,672,393 | 6/1987 | Uchikata et al. | 347/172 |
| 4,695,175 | 9/1987 | Tsukada et al. | 400/240 X |
| 4,766,449 | 8/1988 | Isobe | 347/172 |
| 4,775,578 | 10/1988 | Hayashi et al. | 428/216 |
| 4,835,603 | 5/1989 | Kano et al. | 358/512 |
| 4,845,549 | 7/1989 | Someya | 358/515 |
| 4,887,096 | 12/1989 | Asakura et al. | 347/172 |
| 4,919,555 | 4/1990 | Kikuchi | 400/224.2 |
| 4,925,324 | 5/1990 | Ichisawa et al. | 400/240.3 |
| 5,073,053 | 12/1991 | Kashiwagi | 400/240.3 |
| 5,292,713 | 3/1994 | Stenzel et al. | 503/226 |
| 5,445,463 | 8/1995 | Paranjpe | 400/240 |
| 5,480,237 | 1/1996 | Tanahashi | 400/120.02 |
| 5,487,614 | 1/1996 | Hale | 400/120.02 |
| 5,610,648 | 3/1997 | Sims et al. | 347/174 |
| 5,645,361 | 7/1997 | Mitsushima et al. | 400/636 |
| 5,810,397 | 9/1998 | Mehta et al. | 283/114 |

*Primary Examiner*—John S. Hilten
*Assistant Examiner*—Minh H. Chau
*Attorney, Agent, or Firm*—Nixon & Vanderhye P.C.

[57] ABSTRACT

A multicolor thermal transfer ribbon having black ink and at least two other color inks besides black and white is used with a thermal transfer printer and a label in a method of labeling packages. Variable black ink indicia is imaged, using the thermal transfer printer and ribbon, on a first face of the label, and color indicia from at least one of the at least two other color inks on the ribbon is also imaged on the first face of the label. Then the pressure sensitive adhesive of the second face of the label is pressed onto a package (such as an envelope, carton, etc.). The black variable indicia preferably includes variable bar code and text indicia including address indicia, and the color indicia is preferably just one color, indicating a particular type of express delivery service. In one embodiment the ribbon is about four inches wide, three inches of that being the black portion and the other inch the multicolored portion, and the multicolored portion preferably comprises three or four different colors repeating about every six inches along the length of the ribbon. Sense marks are provided on the back of the ribbon which are sensed to effect control of the ribbon drive for the thermal printer to make sure that the ribbon is in proper registry with the label during printing.

22 Claims, 2 Drawing Sheets

MULTICOLOR THERMAL TRANSFER IMAGING PROCESS

BACKGROUND AND SUMMARY OF THE INVENTION

Conventional delivery services, especially long distance express delivery services, offer a wide variety of different types of service which it is important for those sorting, viewing, making up, and delivering packages be able to easily recognize. This is typically done by printing the type of delivery service on a package label with color indicia which indicates the type of service. However since conventional cost effective printers, such as thermal transfer printers, are not capable of printing the same label with one of the multiple colors that are used for different types of delivery service, and also bar code, text, and like variable indicia (such as address indicia), it is necessary to print two different labels in some circumstances, and three in others where a compliance label, a service indicator label, and a D.O.T. label are utilized.

According to the present invention a thermal transfer ribbon, and a method of utilization thereof for labeling packages, are provided which allow a single label to be printed with variable indicia, such as bar code and text indicia, such as address indicia, and for color indicia, such as indicating the type of delivery service provided for the package to which the label is applied, also imaged on the same label. In order to achieve this result a special thermal transfer ribbon having multiple other colors (besides black) must be utilized. However conventional thermal transfer ribbons are either single color, or at most contain one other color besides black, and therefore are incapable of effective utilization with labels that might require two or more other colors besides black, and therefore conventional ribbons cannot solve the problem that is solved according to the invention. While multicolor ribbons per se are known (such as shown in U.S. Pat. Nos. 4,766,449, 4,835,603, and 4,925,324) conventional multicolor ribbons are also incapable of achieving the desired results that can be achieved according to the invention.

The thermal transfer ribbon and method of labeling packages utilizing the thermal transfer ribbon according to the present invention are highly advantageous compared to conventional ribbons and methods.

According to one aspect of the present invention a thermal transfer ribbon elongated in a first dimension is provided comprising the following components: A first substantially continuous black thermal transfer ink portion elongated in the first dimension and having a first width in a second dimension, substantially transverse to the first dimension. A second multicolored thermal transfer ink portion adjacent the first black thermal transfer ink portion and elongated in the first dimension and having a second width in the second dimension. And, the second multicolored thermal transfer ink portion including at least two ink colors other than black and white having a predetermined length in the first dimension, and substantially regularly repeating along the length of the ribbon in the first dimension. The thermal transfer ribbon is otherwise conventional, including the ink, substrate, and any other aspect thereof.

Preferably the thermal transfer ink multicolored portion includes at least three colors other than black or white substantially regularly repeating along the length of the ribbon in rectangular configuration consecutive and adjacent sections, and each of the colors preferably has substantially the same predetermined length. For example the multicolored thermal transfer ink portion includes at least four colors other than black and white (e.g. including red, blue, green and another color, such as orange) substantially regularly repeating along the length of the ribbon.

Especially for the printing of a four inch by six inch compliance label, such as the type used in association with conventional delivery services, each of the colors of the multicolored thermal transfer ink portion has a predetermined length of about 1.5 inches, which repeat approximately every six inches; and the first width is about three inches and the second width about one inch.

The ribbon also preferably comprises sense marks which facilitate determination of where the colors of the multicolored portion are located along the first dimension to facilitate proper registration of the ribbon with a thermal printer. For example a sense mark may be provided for each of the colored portions. Typically the ribbon has a first face containing ink, and a second non-inked face, and the sense marks are preferably on the second, non-inked, face, although they can also or alternatively be provided on the first face.

According to another aspect of the present invention a method of labeling packages utilizing a thermal transfer printer, a multicolor thermal transfer ribbon comprising black ink and at least two other color inks besides black and white, and a label having a first face for receipt of indicia and a second face having pressure sensitive adhesive, is provided. The method comprises: (a) Using the thermal transfer printer and ribbon, imaging variable black ink indicia on the first face of the label. (b) Using the thermal transfer printer and ribbon, also imaging colored indicia from at least one of the at least two other color inks on the first face of the label. And, (c) placing on a package the pressure sensitive adhesive of the second face of the label having both variable black indicia and colored indicia on the first face thereof.

Typically (a) is practiced to print variable bar code and text indicia, including typically address indicia (both human and machine readable), and (b) is typically practiced to print only one of the other colors on the label, and wherein that other color is indicative of a particular type of delivery service. For example the ribbon may comprise at least three other colors (e.g. four or even more colors) and be as practiced to print only one of the at least three other colors on the label.

The ribbon may have sense marks indicating the positions of the at least two (or at least three) other color inks thereon, in which case the method further comprises (d) sensing the sense marks; and (e) using the sensed information from (d) to control the registry of the colored ink portions of the ribbon with the thermal transfer printer to insure that the desired ink color is printed in (b).

In the practice of the method, the label may be a lined label, having a release liner covering the address face, in which case the method further comprises (d), between (b) and (c), removing the release liner before applying the label to the package. Alternatively the label may be a linerless label having no release liner covering the adhesive face, in which case (c) is practiced substantially immediately after (b), there being no reason to remove the release liner.

While the invention has other applicabilities, it is particularly suitable for use by package delivery services which have a wide variety of different types of services (such as one day early, one day afternoon, two day, Saturday, etc.), and including long distance delivery services. By providing a single label having all the variable indicia necessary to provide the address for and track the label (e.g. some of the variable indicia including bar tracking indicia) and additionally clearly indicate to everyone viewing the label the type of delivery service that is provided (since the label is effectively color coded) a highly advantageous package labeling system is provided.

It is the primary object of the present invention to provide a highly advantageous thermal transfer ribbon, and a method of labeling packages utilizing that ribbon, so as to be able to substantially decrease package labeling costs. This and other objects of the invention will become clear from an inspection of the detailed description of the invention, and from the appended claims.

DETAILED DESCRIPTION OF THE DRAWINGS

Figure 1:
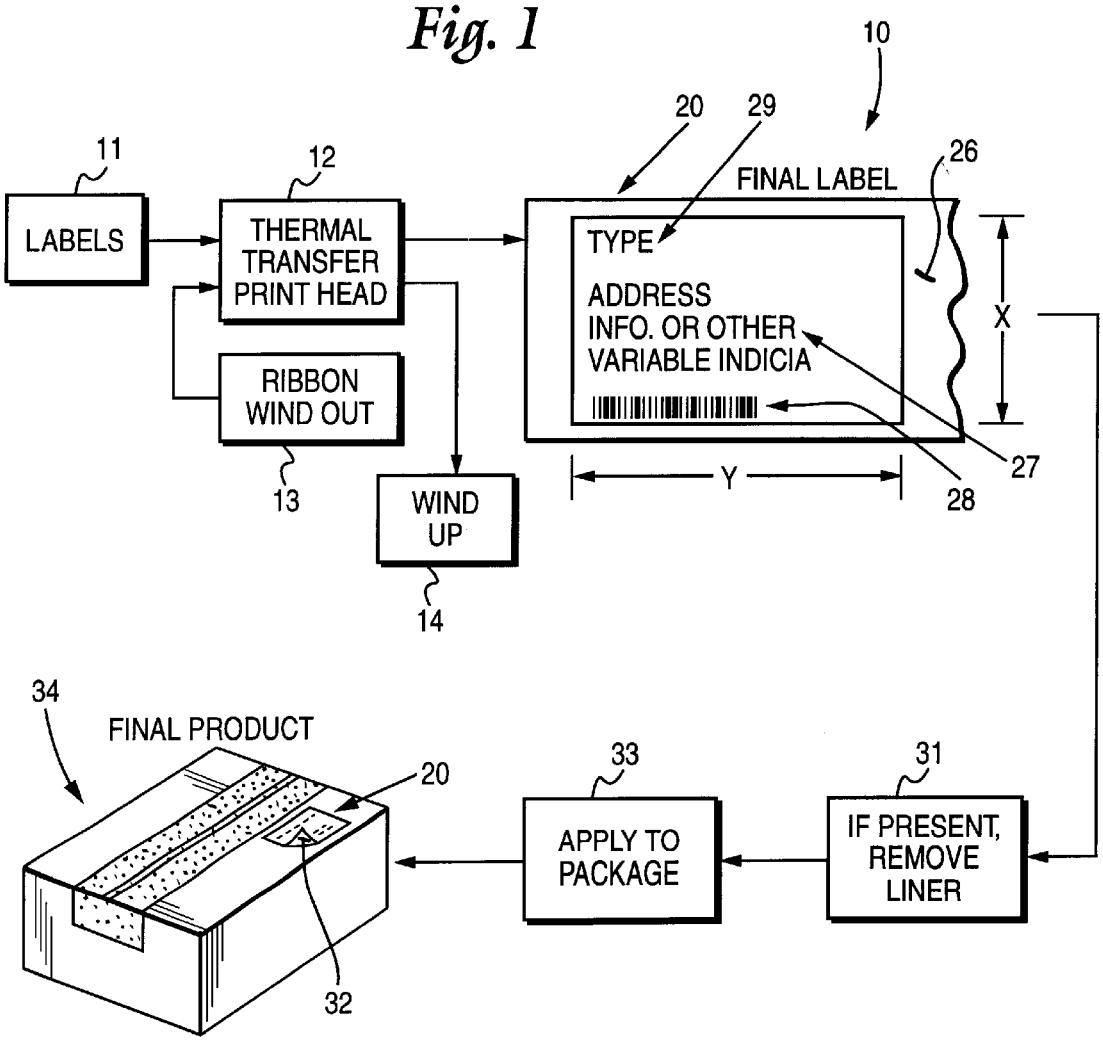
FIG. 1 is a schematic view of an exemplary method according to the present invention, illustrating production of a label, and application of the label to a package, in more detail.

An exemplary method 10 for practicing the present invention is schematically illustrated in FIG. 1. Labels from a source 11 of labels (e.g. a roll, stack, or the like), which may be in individual label form, but preferably in continuous format, are fed by conventional label feeding mechanisms (such as with rollers, tractor drives, or the like) to a conventional thermal transfer printhead 12. Also fed to the conventional printhead 12 is thermal transfer ribbon from a ribbon wind out 13, the ribbon being driven with respect to the thermal printhead 12 by any conventional structures, such as rollers, feeders, guides, or the like. The used ribbon is wound up, as schematically illustrated at 14, as is conventional.

Figure 2:
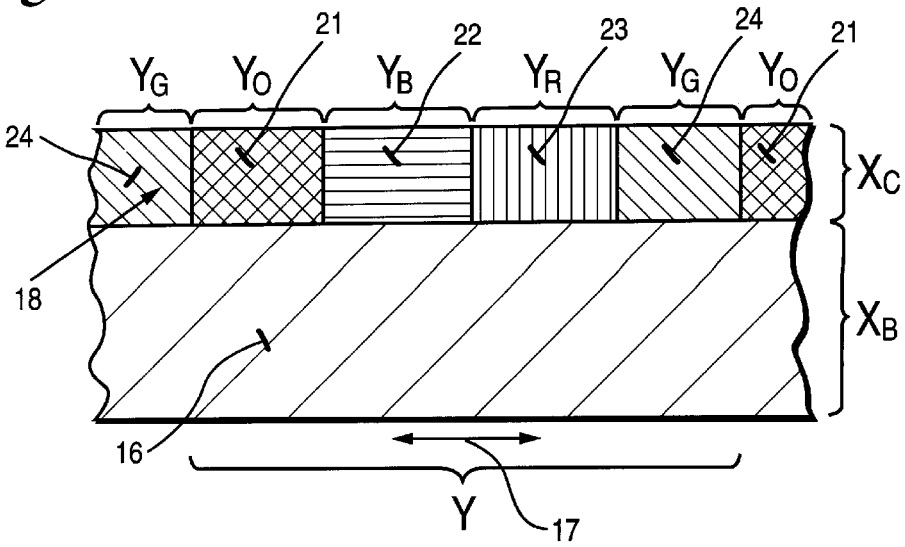
FIG. 2 is a top plan schematic view of the preferred embodiment of a thermal transfer ribbon according to the present invention.

In the practice of the present invention the ribbon from the source 13 is a special type of ribbon, one particular embodiment thereof being illustrated generally by reference numeral 15 in FIG. 2. The ribbon 15 includes a first substantially continuous black thermal transfer ink portion 16 elongated in the dimension of elongation 17 of the ribbon 15. The substrate which supports the ink portion 16, the nature of the thermal transfer ink itself, and the like, are all conventional. In the embodiment illustrated in FIG. 2, which is particularly useful for printing labels from source 11 that are four inch by six inch conventional packaging labels, the black ink portion 16 has a width dimension $X_B$, which is substantially transverse to the dimension of elongation 17, of about three inches.

The ribbon 15 also comprises a second, multicolored, thermal transfer ink portion, shown generally by reference numeral 18, elongated in the first dimension 17 and having a second width $X_C$, which for the particular embodiment illustrated in FIG. 2 is about one inch. $X_B+X_C$ equals X (see FIG. 1), the width of the final label 20 produced, which in one embodiment is about four inches. Preferably the second portion 18 is substantially immediately adjacent the first portion 16 as illustrated in FIG. 2, although under some circumstances there may be a slight space (e.g. non-inked) between them.

The ribbon 15 second multicolored thermal transfer ink portion 18 includes at least two ink colors other than black and white, having a predetermined length in the first dimension 17, and substantially regularly repeating along the length of the ribbon 15 in the first dimension 17. For the particular embodiment illustrated in FIG. 2, an orange ink portion 21, a blue ink portion 22, a red ink portion 23, and a green ink portion 24 are provided in sequence in the dimension 17, one immediately adjacent the other (although there could be a small dividing, non-inked, space between them). The orange portion 21 has a length (in dimension 17) $Y_O$, portion 22 a length $Y_V$, portion 23 a length $Y_R$, and the portion 24 a length $Y_G$. In the embodiment illustrated in FIG. 2 each of these lengths $Y_O$, $Y_V$, $Y_R$, and $Y_G$ is substantially the same, and about 1.5 inches, and the sum of those lengths is about the length Y (see FIG. 1) of the label 20 produced by the thermal printhead 12. The portions 21–24 then repeat continuously in the same sequence in the dimension 17.

As seen for the final label 20 illustrated in FIG. 1, which for this particular embodiment is a lined label, having a release liner 26 mounting the label, it has text and bar code indicia 27 and 28 imaged thereon in black ink. The text indicia 27 may be any suitable text, including variable address indicia, variable delivery instructions, or any other suitable type of variable indicia. The bar code indicia may be address bar code indicia, tracking indicia for the package to which the label 20 is applied, or the like.

The label 20 also includes imaged thereon the indicia 29 which is in one or more of the colors of the portions 21–24, preferably only a single color. The indicia 29 for the preferred embodiment of the method according to the invention is indicative of a particular type of delivery service. For example (only) the orange ink indicia 29 from ribbon portion 21 could indicate the fastest type of delivery, blue ink from portion 22 the second fastest type, red ink from portion 23 the third fastest type, and green ink from portion 24 a particular type of delivery not necessarily related to speed (such as Saturday or Sunday delivery).

After the label 20 is properly imaged, the next step in the method 10 is step 31. In step 31 if present the release liner 26 is removed exposing pressure sensitive adhesive 32 (see FIGS. 1 and 4) on the back of the label 20. The label 20 is then applied to the package, as shown by block 33 in FIG. 1, resulting in a final package 34, having a label 20 applied thereto by pressing the adhesive 32 onto an appropriate portion of the package 34. The package 34 may comprise any conventional type of package, such as an envelope, carton, box, tube, etc.

Figure 3:
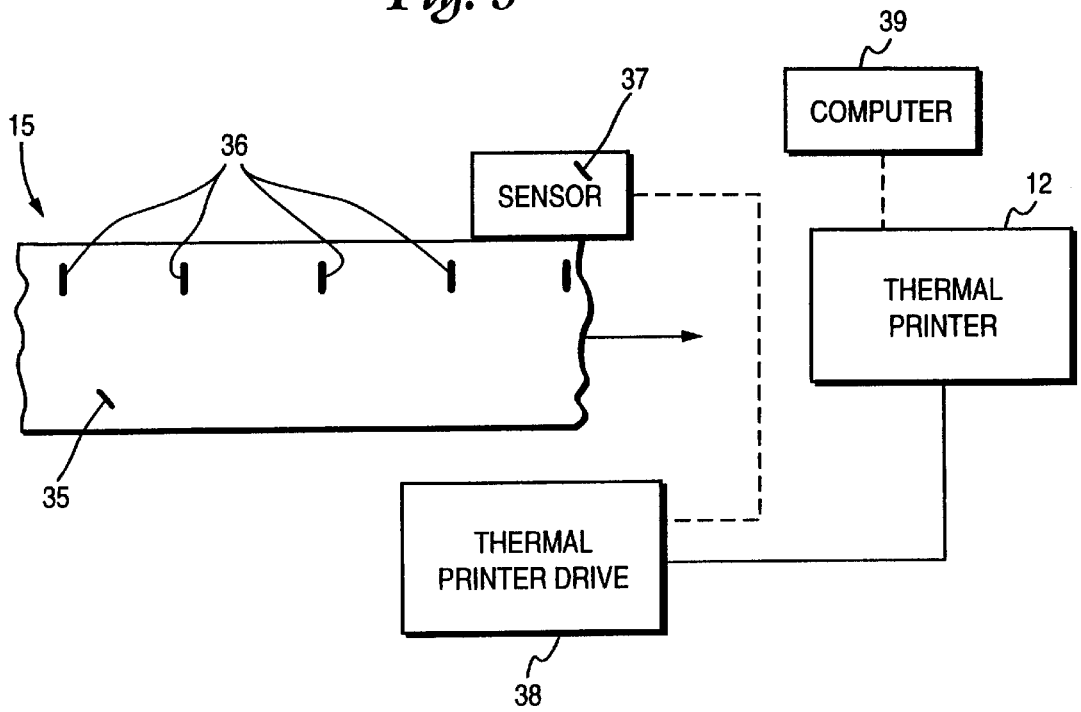
FIG. 3 is a bottom plan schematic view of the label of FIG. 2 and shown schematically in association with various equipment for working with the label to practice a method according to the invention.

FIG. 3 illustrates the back, non-inked, face of the thermal transfer ribbon 15 of FIG. 2. The conventional substrate 35 of the ribbon 15 has a plurality of sense marks 36 formed thereon, preferably one sense mark for each of the colored portions 21 through 24. The sense marks 36 may be of any conventional type, such as optically readable, magnetically readable, etc. The sense marks 36 are sensed by a conventional sensor 37, the sensor 37 being of the type that is capable of sensing the particular sense marks 36 that are provided. For example if the sense marks 36 are optical marks, the sensor 37 is a conventional optical sensor. If,the marks 36 are magnetic marks, the sensor 37 is a conventional magnetic sensor; etc. The sensor 37 is operatively connected to a conventional drive 38 for the thermal printer 12 to properly position the ribbon 15 in the desired location for printing the desired color from one of the portions 21 through 24, as determined by a computer control 39 connected to the thermal printer 12. The computer 39 provides not only the variable indicia 27, 28 to be printed by the black ink portion 16, but also the color (as well as the words or other indicia) of the indicia 29.

Figure 4:
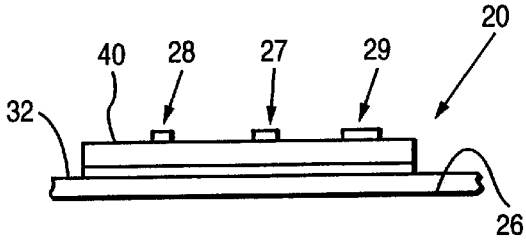
FIG. 4 is a side schematic view, greatly enlarged for clarity of illustration, of an imaged label produced by practicing the method according to the present invention.
Figure 5:
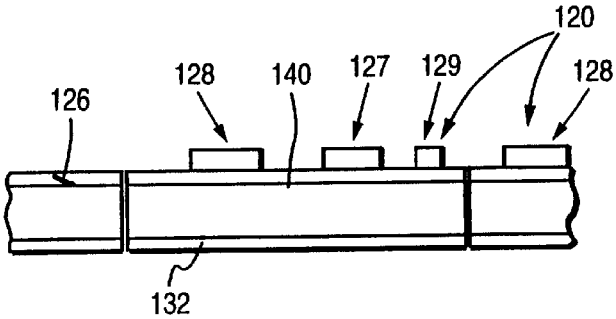
FIG. 5 is a view like that of FIG. 4 only for linerless labels utilized in the practice of the method of the invention, showing the linerless labels in continuous format.

FIG. 4 is a schematic side view of the final label 20 showing the release liner 26, the adhesive 32, and the indicia 27–29 imaged on the top face 40 thereof. FIG. 5 is a view like that of FIG. 4 only for a linerless label embodiment, shown generally by reference numeral 120. In this embodiment elements comparable to those in the FIG. 4 embodiment are shown by the same reference numeral only preceded by a "1".

In the FIG. 5 embodiment the only significant difference between it and the FIG. 4 embodiment is that since the labels 120 are linerless the pressure sensitive adhesive 130 is not covered by a liner, but rather on the top face 140 an adhesive release material 126 is provided, the indicia 127–129 imaged thereon. For example the linerless labels 120 may be of the type such as shown in U.S. Pat. No. 5,292,713 (the disclosure of which is hereby incorporated by reference herein), or any other suitable linerless label that can accept the thermal transfer indicia 127–129.

It will thus be seen that according to the present invention a highly advantageous thermal transfer ribbon 15 including at least two colored portions 21–24 thereof, is provided, as well as a method (as schematically illustrated in FIG. 1) for labeling packages 34 so that a single label 20 may provide black ink variable indicia in the form of text 27 and/or bar coding 28, as well as colored indicia 29 which includes a particular type of delivery service, is provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent products and methods.

What is claimed is:

1. A thermal transfer ribbon elongated in a first dimension and comprising:

a first substantially continuous black thermal transfer ink portion elongated in said first dimension and having a first width in a second dimension, substantially transverse to said first dimension;

a second multicolored thermal transfer ink portion adjacent said first black thermal transfer ink portion and elongated in said first dimension and having a second width in said second dimension;

said second multicolored thermal transfer ink portion including at least two ink colors other than black and white having a predetermined length in said first dimension, and substantially regularly repeating along the length of said ribbon in said first dimension while said black portion is substantially continuous in said first dimension; and wherein said multicolored thermal transfer ink portion includes at least three colors other than black or white substantially regularly repeating along the length of said ribbon in rectangular configuration consecutive and adjacent sections, and wherein each of said colors has substantially the same predetermined length; and wherein said second width is less than said first width.

2. A thermal transfer ribbon as recited in claim 1 wherein said colors include red, blue, and green.

3. A thermal transfer ribbon as recited in claim 1 wherein said multicolored thermal transfer ink portion includes at least four colors other than black and white substantially regularly repeating along the length of said ribbon.

4. A thermal transfer ribbon as recited in claim 3 wherein each of said colors of said multicolored thermal transfer ink portion has a predetermined length of about 1.5 inches, and repeat approximately every six inches; and wherein said first width is about three inches and said second width about one inch.

5. A thermal transfer ribbon as recited in claim 4 further comprising sense marks provided on said thermal transfer ribbon which facilitate determination of where the colors of said colored portion are located along said first dimension to facilitate proper registration of said ribbon with a thermal printer.

6. A thermal transfer ribbon as recited in claim 5 wherein a sense mark is provided for each color of said colored portion, but not said black portion.

7. A thermal transfer ribbon as recited in claim 6 wherein said ribbon has a first face containing ink, and a second non-inked face; and wherein said sense marks are on said second non-inked face.

8. A thermal transfer ribbon as recited in claim 1 wherein said colors of said multicolored portion substantially regularly repeat approximately every six inches along said first dimension; and wherein said first width is approximately three inches, and said second width is approximately one inch.

9. A thermal transfer ribbon as recited in claim 1 further comprising sense marks provided on said thermal transfer ribbon which facilitate determination of where the colors of said colored portion is located along said first dimension to facilitate proper registration of said ribbon with a thermal printer.

10. A thermal transfer ribbon as recited in claim 9 wherein a sense mark is provided for each color of said colored portion.

11. A thermal transfer ribbon as recited in claim 10 wherein said ribbon has a first face containing ink, and a second non-inked face; and wherein said sense marks are on said second non-inked face.

12. A thermal transfer ribbon as recited in claim 9 wherein said ribbon has a first face containing ink, and a second non-inked face; and wherein said sense marks are on said second non-inked face.

13. A method of labeling packages utilizing a thermal transfer printer, a multicolor thermal transfer ribbon comprising black ink and at least two other color inks besides black and white, the ribbon elongated in a first dimension, and a label having a first face for receipt of indicia and a second face having pressure sensitive adhesive; said method comprising:

(a) using the thermal transfer printer and ribbon, imaging variable black ink indicia on the first face of the label at a first area;

(b) using the thermal transfer printer and ribbon, also imaging colored indicia from at least one of the at least two other color inks on the first face of the label in a second area spaced from the first area in a second dimension, substantially transversely to the first dimension;

(c) placing on a package the pressure sensitive adhesive of the second face of the label having both variable black indicia and colored indicia on the first face thereof; and wherein the thermal transfer ribbon comprises a first substantially continuous black thermal transfer ink portion elongated in a first dimension and having a first width in a second dimension substantially transverse to the first dimension; and a second multi-color thermal transfer ink portion adjacent the first black thermal transfer ink portion and elongated in the first dimension and having a second width in the second dimension, less than the first width; the at least two colors other than black and white in the multi-color thermal transfer ink portion substantially regularly repeating along the length of the ribbon in the first dimension; and wherein (b) is practiced to print only one of the at least two other colors on the label on one portion of the label, while (a) is practiced to print black indicia on the label at a portion spaced in the second dimension from the color ink indicia portions.

14. A method as recited in claim 13 wherein (a) is further practiced to print variable bar code and text indicia including address indicia.

15. A method as recited in claim 14 wherein (b) is practiced to print only one of the other colors on the label, and wherein that other color is indicative of a particular type of delivery service.

16. A method as recited in claim 13 wherein the label has a width substantially parallel to a width of the ribbon; and wherein the ribbon comprises at least three other colors, and wherein (b) is practiced to print only one of the at least three other colors on the label, and at a different location along the label width than the black indicia printed in (a).

17. A method as recited in claim 13 wherein the ribbon has a front containing the colored inks, and a non-inked back; and wherein the ribbon has sense marks on the back indicating the positions of the at least two other color inks thereon; and further comprising (d) sensing the sense marks; and (e) using the sensed information from (d) to control the registry of the colored ink portions of the ribbon with the thermal transfer printer to insure that the desired ink color is printed in (b).

18. A method as recited in claim 17 wherein (a) is further practiced to print variable bar code and text indicia including address indicia.

19. A method as recited in claim 13 wherein the label is a lined label, having a release liner covering the adhesive face; and further comprising (d), between (b) and (c), removing the release liner before applying the label to the package.

20. A method as recited in claim 13 wherein the label is a linerless label having no release liner covering the adhesive face; and wherein (c) is practiced substantially immediately after (b).

21. A method as recited in claim 13 wherein the ribbon has a front containing the colored inks, and a non-inked back; and wherein the ribbon has sense marks on the back indicating the positions of the at least two other color inks thereon; and further comprising (d) sensing the sense marks; and (e) using the sensed information from (d) to control the registry of the colored ink portions of the ribbon with the thermal transfer printer to insure that the desired ink color is printed in (b).

22. A thermal transfer ribbon elongated in a first dimension and comprising:

a first substantially continuous black thermal transfer ink portion elongated in said first dimension and having a first width in a second dimension, substantially transverse to said first dimension;

a second multicolored thermal transfer ink portion adjacent said first black thermal transfer ink portion and elongated in said first dimension and having a second width in said second dimension;

said second multicolored thermal transfer ink portion including at least two ink colors other than black and white having a predetermined length in said first dimension, and substantially regularly repeating along the length of said ribbon in said first dimension while said black portion is substantially continuous in said first dimension; and wherein said colors of said multicolored portion substantially regularly repeat approximately every six inches along said first dimension; and wherein said first width is approximately three inches, and said second width is approximately one inch.

* * * * *